US008339277B2

(12) United States Patent
Spross et al.

(10) Patent No.: US 8,339,277 B2
(45) Date of Patent: Dec. 25, 2012

(54) COMMUNICATION VIA FLUID PRESSURE MODULATION

(75) Inventors: Ronald L. Spross, Humble, TX (US); Kenneth J. Bryars, Kingwood, TX (US); Andrew J. Downing, Tomball, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 451 days.

(21) Appl. No.: 12/445,393

(22) PCT Filed: Apr. 12, 2007

(86) PCT No.: PCT/US2007/009061

§ 371 (c)(1),
(2), (4) Date: Mar. 5, 2010

(87) PCT Pub. No.: WO2008/127230

PCT Pub. Date: Oct. 23, 2008

(65) Prior Publication Data

US 2010/0148987 A1 Jun. 17, 2010

(51) Int. Cl.
*G01V 3/00* (2006.01)

(52) U.S. Cl. ..... 340/854.3; 173/197; 73/152.18

(58) Field of Classification Search ..... 173/197; 73/152.18; 340/854.3
See application file for complete search history.

(56) References Cited

U.S. PATENT DOCUMENTS

| | | | | |
|---|---|---|---|---|
| 3,248,938 | A * | 5/1966 | Hill et al. | 73/152.18 |
| 3,416,613 | A * | 12/1968 | Henderson | 173/197 |
| 4,273,212 | A * | 6/1981 | Dorr et al. | 181/102 |
| 6,909,667 | B2 | 6/2005 | Shah et al. | |
| 7,123,161 | B2 | 10/2006 | Jeffryes et al. | |
| 7,158,446 | B2 | 1/2007 | Gardner et al. | |
| 2003/0218940 | A1 | 11/2003 | Jogi et al. | |

FOREIGN PATENT DOCUMENTS

| | | | |
|---|---|---|---|
| GB | 2247667 | A | 8/1994 |
| GB | 2357527 | A | 6/2001 |
| GB | 2383356 | A | 6/2003 |
| WO | WO-2008/127230 | | 10/2008 |
| WO | WO-2008/127230 | A3 | 10/2008 |

OTHER PUBLICATIONS

"International Application Serial No. PCT/US2007/09061, Search Report and Written Opinion mailed on Oct. 16, 2008", P220.

"Search Report for Application No. 1880.143wo1", 10 Pages.

MacPherson, J. D., et al., "Application and Analysis of Simultaneous Near Bit and Surface Dynamics Measurements", *SPE Drilling & Completion*, 16(4), (2001), 230-238.

Montaron, B. A., et al., "Improvements in MWD Telemetry: "The Right Data at the Right Time"", *SPE Asia Pacific Oil and Gas Conference*, (1993), 337-346.

* cited by examiner

*Primary Examiner* — Jean B Jeanglaude

(74) *Attorney, Agent, or Firm* — Schwegman Lundberg & Woessner, P.A.

(57) ABSTRACT

In some embodiments, an apparatus [100] and a system, as well as a method and an article, may operate to transmit downhole data in a drilling fluid via fluid pressure modulation, and receive the downhole data at a fluid pulse receiver included in a conduit [104] coupled to a drill pipe downstream from a Kelly hose. Other apparatus, systems, and methods are disclosed.

30 Claims, 5 Drawing Sheets

COMMUNICATION VIA FLUID PRESSURE MODULATION

This application is a U.S. National Stage Filing under 35 U.S.C. 371 from International Application Number PCT/US2007/009061, filed Apr. 12, 2007 and published in English as WO 2008/127230 A2 on Oct. 23, 2008, which application and publication are incorporated herein by reference in their entirety.

TECHNICAL FIELD

Various embodiments described herein relate to data processing, including the communication of data via fluid pressure modulation.

BACKGROUND INFORMATION

Real time logging while drilling (LWD) telemetry may be accomplished via transmission and detection of pulses in drilling fluid that flows through the bore of the drill pipe and drill collars. Pulses may be positive or negative, and are typically detected by one or more transducers placed in the surface plumbing between the rig floor and the mud pumps. However, the detected signal quality can be affected by the intrusion of downhole noise (e.g., drilling noise) and surface noise (e.g., mud pump noise). When the signal-to-noise ratio (SNR) of received signals is reduced, operators may reduce the data transmission rate to improve the quality of the received data. Thus, there is a need for apparatus, systems, and methods to improve the SNR of received LWD telemetry signals.

DETAILED DESCRIPTION

Drilling mud telemetry pulses are typically detected using transducers placed in the rig surface plumbing between the mud pump and the Kelly hose. The fidelity of the waveforms received by the transducers depends on the transducer proximity to noise sources, reflectors, and other surface plumbing features, as well as the amplitude of the pulse from downhole.

Using transducers in this conventional fashion, that is, "upstream" in the sense of the direction of mud flow, can exacerbate the problems introduced by rig plumbing noise. This is because the detected signal in this case is a superposition of the waveforms from downhole, and one or more reflections from features in the surface plumbing. The reflection can be inverting or not, depending on the configuration of the pulsation dampener. If it is inverting, much of the pulse energy from downhole can be canceled through interference of direct and reflected pulses, especially if the transducer is located proximate to the reflection point. Thus, the various embodiments described herein operate to detect mud pulse telemetry signals further away from the surface plumbing reflections than currently permitted when transducers are located between the upstream end of the Kelly hose and the mud pumps.

The speed of sound in drilling mud is typically slower than it is in water (i.e., less than about 1600 m/sec). Thus, given a telemetry pulse width of about 0.1 seconds or more (in time), it is desirable to locate transducers at least 75 m away from an inverting reflection point to reduce the effects of destructive interference and loss of energy in the detected wave form.

Therefore, in order to improve the SNR of detected telemetry signals in the drilling environment, many of the embodiments disclosed herein make use of one or more telemetry reception transducers in a sub-assembly that attaches to the bottom of the top drive, or the top of a Kelly, whichever is applicable to a particular drilling operation. This increases the round-trip travel time between the transducer and signal reflectors, reducing energy loss, and improving the SNR of the received signal.

Inserting an orifice in the mud flow path, or flowline, can further enhance the telemetry signal received from downhole. This occurs because the orifice is a location where the pulse from downhole is partially reflected and partially transmitted. The pulse waveform reflected from the orifice is not inverted, so that for a transducer that is close to the downstream side of the orifice, the reflected wave can constructively interfere with the unreflected downhole pulse, enhancing detectability. Further, an orifice used in this manner can reduce the amplitude of noise contributed from the pumps. This is why a useful location for such an orifice is in the flowline.

Figure 1A:
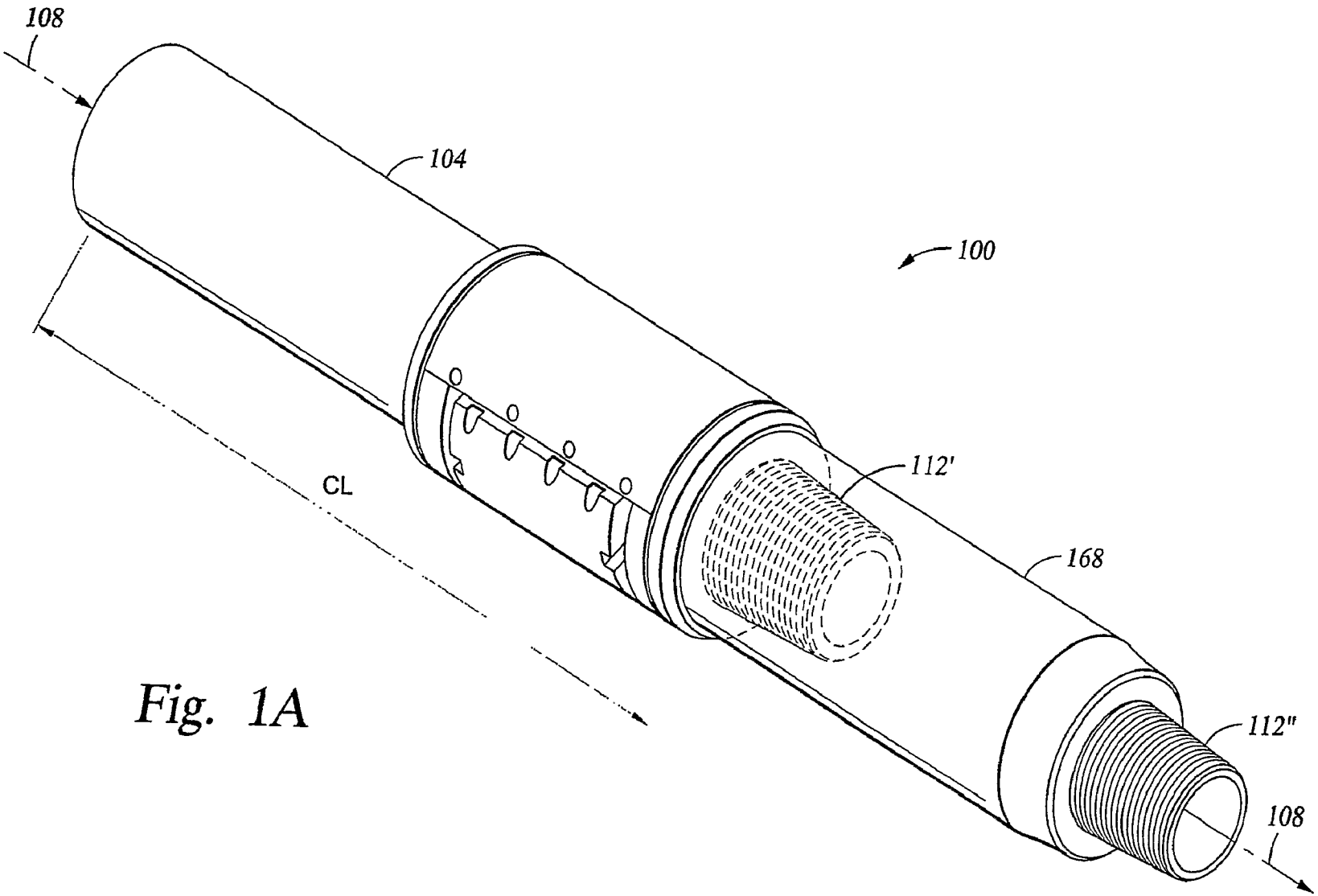
FIGS. 1A-1C are perspective, cut-away perspective, and cut-away side views of an apparatus according to various embodiments of the invention.
Figure 1B:
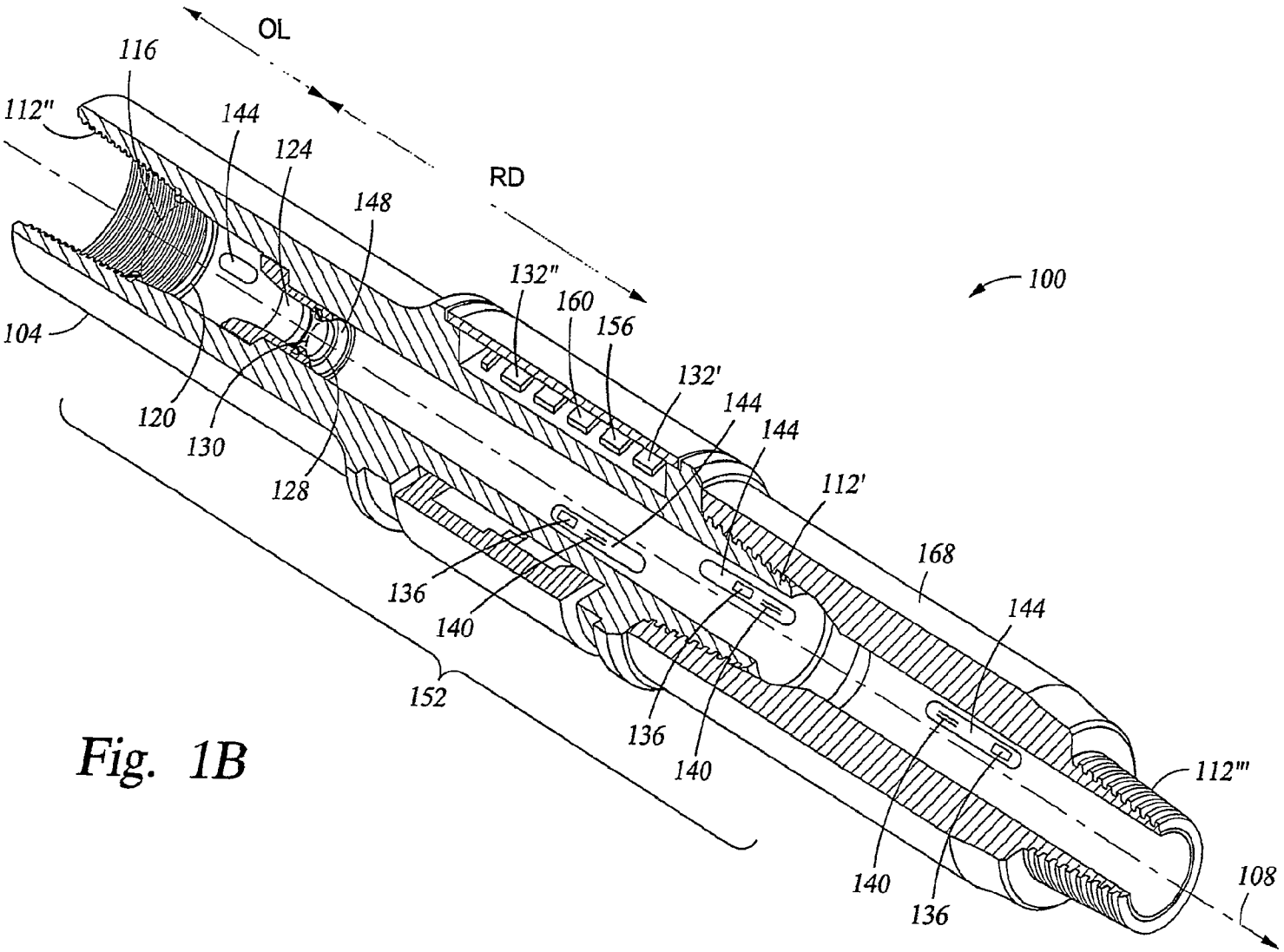
Figure 1C:
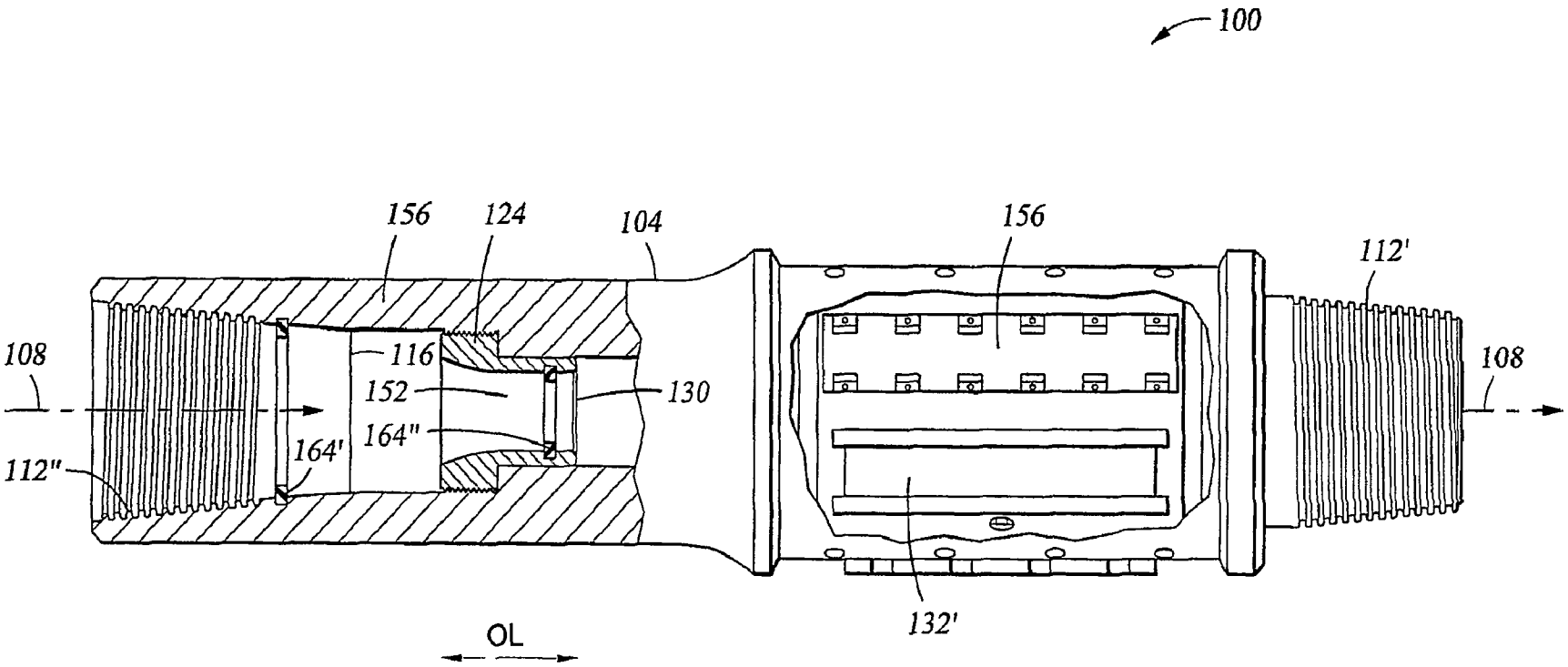

FIGS. 1A-1C are perspective, cut-away perspective, and cut-away side views of an apparatus 100 according to various embodiments of the invention. Here the apparatus 100, in the form of a subassembly, can include a length CL of conduit 104 (e.g., drill pipe) which contains or is attached to one or more pressure transducers or fluid pulse receivers 132', 132" that can provide signals corresponding to pressure variations in the drilling fluid in the bore of the conduit 104, along the flow path 108.

Thus, in some embodiments, the apparatus 100 comprises a length CL of conduit 104 to form a portion of a drilling fluid flow path 108. The conduit 104 may comprise substantially cylindrical metallic pipe, including drill pipe. The apparatus 100 may also include one or more fluid pulse receivers 132', 132" to receive modulated data 136 propagated via pressure waves 140 in a drilling fluid 144 contained by the enclosed portion of the drilling fluid flow path 108.

The conduit 104 may include a drill pipe attachment 112' and a first opening 116 to define a first flow path area 120 along the drilling fluid flow path 108. The conduit 104 may include a second drill pipe attachment 112", if desired, to couple the conduit 104 to a Kelly or top drive.

Drill pipe sections (see elements 218 of FIG. 2) may be coupled directly to the drill pipe attachment 112' of the conduit. Alternatively, a saver subassembly 168 may be coupled to (e.g., screwed on to) the drill pipe attachment 112' of the conduit 104, and drill pipe sections may be coupled to the drill pipe attachment 112'" of the saver subassembly 168.

The apparatus 100 includes an orifice 124 to reduce the first flow path area 120 to a second flow path area 128 defined by a second opening 130, which may in turn be located in the downstream end of the orifice 124. For the purposes of this document, "downstream" means the direction shown by the arrow indicating the flow path 108, moving from the location of the orifice 124 along the fluid flow path 108 toward the drill pipe attachment 112' of the conduit 104. Thus, one or more fluid pulse receivers 132', 132" can be attached to the conduit 104 downstream along the drilling fluid flow path 108 from the orifice 124. One or more of the fluid pulse receivers 132', 132" may be located at a distance RD from the orifice 124, which is less than 10% of a downstream sonic distance defined by an average pulse width of the modulated data 136 in the drilling fluid 144 from the orifice 124 along the drilling fluid flow path 108. For example, the sonic distance in the drilling fluid 144 defined by a pulse width of 0.1 seconds is about 160 m, since the speed of sound is about 1600 m/s in the average drilling fluid 144. Heavier fluids would, as noted above, have lower acoustic velocities and correspondingly shorter sonic distances. Thus, 10% of this distance is about 16 m.

The orifice 124 has an orifice length OL along the drilling fluid flow path 108 that is less than the length CL of the conduit 104 along the drilling fluid flow path 108. The orifice 124 may have any number of interior profiles along the fluid flow path 108, including the substantially tapered profile shown. Thus, the second opening 130 may serve to define an exit point of a substantially tapered orifice chamber 152.

The orifice 124 can operate as an insert that is removably replaceable within the apparatus 100, so that the orifice characteristics can be changed as part of the drilling process, if desired. For example, as shown in FIG. 1B, the orifice 124 can be threaded into place.

A wireless transmitter 156 may be included in the apparatus 100 and coupled to the fluid pulse receivers 132', 132". The wireless transmitter 156 can receive the modulated data 136 provided by the fluid pulse receivers 132', 132" for retransmission to a remote unit receiver (not shown in FIG. 1), perhaps located on the rig floor, to send the data 136 on to a logging unit. The fluid pulse receivers 132', 132" can communicate with the wireless transmitter 156 either by providing an analog electrical signal output or a digital electrical signal output, depending on the design of the wireless transmitter 156. A conversion module 160 may be coupled to the fluid pulse receivers 132', 132" included in the apparatus 100 to convert the modulated data 136 from an analog form to a digital form, or vice versa.

In some embodiments of the apparatus 100, the first flow path area 120 and/or the second flow path area 128 may adjustable responsive to mechanical forces or electrical signals. For example, the apparatus 100 may include iris mechanisms 164', 164" that have a variable aperture responsive to mechanical force (e.g., hydraulic pressure) or an electrical impulse (e.g., a solenoid). Other mechanisms, such as annular inserts 164', 164" that expand or contract to adjust one or more of the flow path areas 120, 128 responsive to fluid pressure, may also be used.

Figure 2:
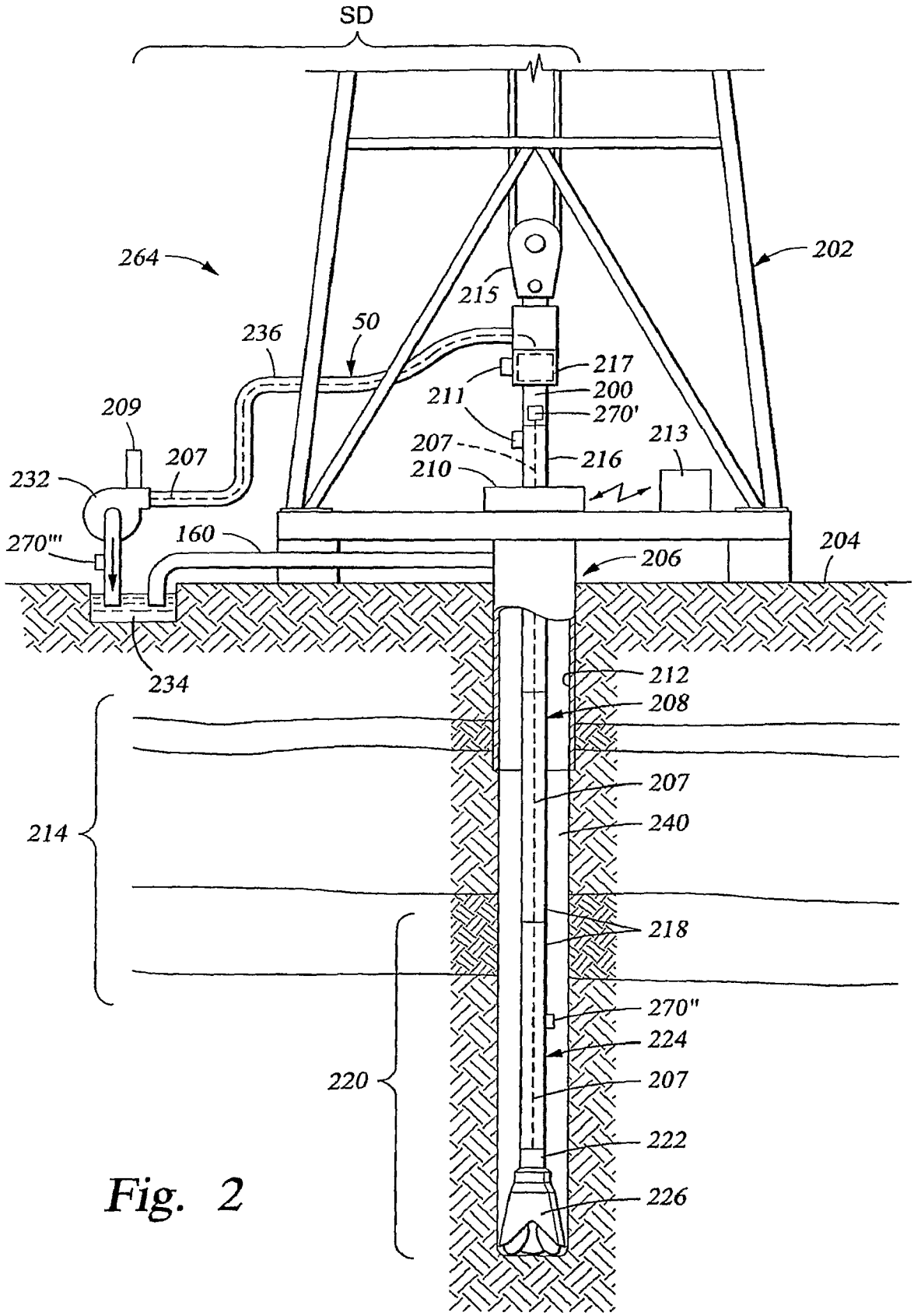
FIG. 2 illustrates apparatus and systems according to various embodiments of the invention.

FIG. 2 illustrates apparatus 200 and systems 264 according to various embodiments of the invention. The apparatus 200 may be similar to or identical to the apparatus 100 described above and shown in FIGS. 1A-1C.

For example, it can be seen how a system 264 may form a portion of a drilling rig 202 located at a surface 204 of a well 206. The drilling rig 202 may provide support for a drill string 208. The drill string 208 may include wired and unwired drill pipe, as well as wired and unwired coiled tubing, including segmented drilling pipe, casing, and coiled tubing. The drill string 208 may include drill pipe 218, and a bottom hole assembly 220, perhaps located at the lower portion of the drill pipe 218.

In older rigs 202, a Kelly 216 may form part of the drill string 208, and the Kelly 216 may operate to penetrate a rotary table 210 which couples to the Kelly 216 for drilling a borehole 212 through subsurface formations 214. In newer rigs 202, in lieu of a rotary table 210 and Kelly 216, a top drive 217 may be attached to a hoist 215 and the drill string 208.

The bottom hole assembly 220 may include drill collars 222, a downhole tool 224, and a drill bit 226. The drill bit 226 may operate to create a borehole 212 by penetrating the surface 204 and subsurface formations 214. The downhole tool 224 may comprise any of a number of different types of tools including measurement while drilling (MWD) tools, logging while drilling (LWD) tools, and others.

During drilling operations, the drill string 208 (perhaps including the Kelly 216, the drill pipe 218, and the bottom hole assembly 220) may be rotated by the rotary table 210. As mentioned previously, the Kelly 216 may be absent, and a top drive 217 may be used to turn the drill string 208. The drill collars 222 may be used to add weight to the drill bit 226. The drill collars 222 also may stiffen the bottom hole assembly 220 to allow the bottom hole assembly 220 to transfer the added weight to the drill bit 226, and in turn, assist the drill bit 226 in penetrating the surface 204 and subsurface formations 214.

During drilling operations, a mud pump 232 may pump drilling fluid (similar to or identical to the fluid 144 of FIG. 1B, and sometimes known by those of ordinary skill in the art as "drilling mud") 234 from a mud pit through a Kelly hose 236 into the drill pipe 218 and down to the drill bit 226. The drilling fluid 234 can flow along the flow path 207 and out from the drill bit 226 to be returned to the surface 204 through an annular area 240 between the drill pipe 218 and the sides of the borehole 212. The drilling fluid 234 may then be returned to the mud pit, where it can be filtered. In some embodiments, the drilling fluid 234 can be used to cool the drill bit 226, as well as to provide lubrication for the drill bit 226 during drilling operations. Additionally, the drilling fluid 234 may be used to remove subsurface formation 214 cuttings created by operating the drill bit 226.

Thus, referring now to FIGS. 1A-1C and 2, it may be seen that in some embodiments, the system 264 may include a drill string 208 coupled to one of the drill pipe attachments at the downstream end of the apparatus 200, either directly, or via a saver subassembly. A top drive 217 may be attached to the upstream end of the apparatus 200. If a Kelly 216 is used, then the Kelly 216 may be attached to the apparatus 200 at its downstream end, either directly, or via a saver subassembly. The system 264 may comprise an LWD tool 224 to provide modulated data to the apparatus 200, which may be retransmitted to a remote receiver unit 213. The LWD tool 224 may be coupled to the drill string 208.

The system 264 may also include a mud pump 232 to pump the drilling fluid 234, and a pulsation dampener 209 coupled to the mud pump 232. In some embodiments, the system 264 may include a Kelly hose 236 fluidly coupled to the conduit of the apparatus 200, such that a fluid pulse receiver 270' can be used to monitor fluid pressure along the drilling fluid flow path 207 on the drill string side of the Kelly hose.

Thus, fluid pulse receivers 270', 270", 270'" which may be similar to or identical to the receivers 132', 132", may be located in a variety of places within the system 264. For example, a first fluid pulse receiver 270' can be located approximately one-half of a downstream sonic distance SD defined by an average pulse width of the modulated data in the drilling fluid 234 from the pulsation dampener 209 along the drilling fluid flow path 207 (e.g., via the Kelly hose 236 and the drill string 208, including Kelly 216 (if used), the apparatus 200, and the drill pipe 218). While the first fluid pulse receiver 270' is shown and described herein as being attached to or housed by the conduit of the apparatus 200 (and 100 in FIGS. 1A-1C), the various embodiments described herein are not to be so limited. Thus, the first fluid pulse receiver 270' can also be located apart from the apparatus 200, such as at the locations depicted for the fluid pulse receivers 270" and 270'".

In some embodiments, a second fluid pulse receiver 270" can be spaced apart from the first fluid pulse receiver 270' along the drilling fluid flow path 207. The second fluid pulse receiver 270" can be used to monitor a second fluid pressure along the drilling fluid flow path 207 on the drill string side of the Kelly hose 236. A second (or a third) fluid pulse receiver 270'" may also be spaced apart from the first fluid pulse receiver 270' along the drilling fluid flow path 270, and used to monitor fluid pressure along the drilling fluid flow path 207 on a non-drill string side of the Kelly hose.

As noted previously, the first and second flow path areas in the apparatus 200 (see elements 120, 128 in apparatus 100 of FIG. 1B) may be designed to be adjustable responsive to drilling conditions (e.g., peak or average drilling fluid pressure along the flow path 207, current viscosity of the drilling fluid 234, the type of formation encountered by the drill bit 226, drilling fluid flow rate, standpipe pressure, mud weight or changes made to pulsing parameters, in various combinations or individually). The adjustments may occur in substantially real time.

If the top drive 217 or Kelly 216 operates to inject unwanted noise into the modulated data communicated by the drilling fluid 234 along the flow path 207, one or more accelerometers or transducers 211 may be placed on the top drive 217 or Kelly 216, with the transducer output included in the transmissions to the remote receiver unit 213. The output signal can provide a mechanism to filter out the noise originating from the top drive 217 or Kelly 216, as is known to those of ordinary skill in the art. Thus, the system 264 may include one or more vibration transducers 211 attached to the top drive 217 or Kelly 216 in some embodiments.

The apparatus 100, 200; conduit 104; flow paths 108, 207; drill pipe attachments 112', 112"; openings 116, 130; flow path areas 120, 128; orifice 124; fluid pulse receivers 132', 132", 270', 270", 270'"; modulated data 136; pressure waves 140; drilling fluid 144, 234; entry point 148; orifice chamber 152; wireless transmitter 156; conversion module 160; iris mechanisms or annular inserts 164', 164"; saver subassembly 168; drilling rig 202; surface 204; well 206; drill string 208; pulsation dampener 209; rotary table 210; vibration transducers 211; borehole 212; remote receiver unit 213; formations 214; hoist 215; Kelly 216; top drive 217; drill pipe 218; bottom hole assembly 220; drill collars 222; downhole tool 224; drill bit 226; mud pump 232; hose 236; annular area 240; systems 264; conduit length CL; orifice length OL; receiver distance RD; and sonic distance SD may all be characterized as "modules" herein. Such modules may include hardware circuitry, and/or a processor and/or memory circuits, software program modules and objects, and/or firmware, and combinations thereof, as desired by the architect of the apparatus 100, 200 and systems 264, and as appropriate for particular implementations of various embodiments. For example, in some embodiments, such modules may be included in an apparatus and/or system operation simulation package, such as a software electrical signal simulation package, an alignment and synchronization simulation package, and/or a combination of software and hardware used to simulate the operation of various potential embodiments.

It should also be understood that the apparatus and systems of various embodiments can be used in applications other than for drilling and logging operations, and thus, various embodiments are not to be so limited. The illustrations of apparatus 100, 200, and systems 264 are intended to provide a general understanding of the structure of various embodiments, and they are not intended to serve as a complete description of all the elements and features of apparatus and systems that might make use of the structures described herein.

Applications that may include the novel apparatus and systems of various embodiments include electronic circuitry used in communication and signal processing circuitry, modems, processor modules, embedded processors, data switches, and application-specific modules. Such apparatus and systems may further be included as sub-components within a variety of electronic systems, such as televisions, personal computers, workstations, vehicles, including aircraft and watercraft, as well as cellular telephones, among others. Some embodiments include a number of methods.

Figure 3:
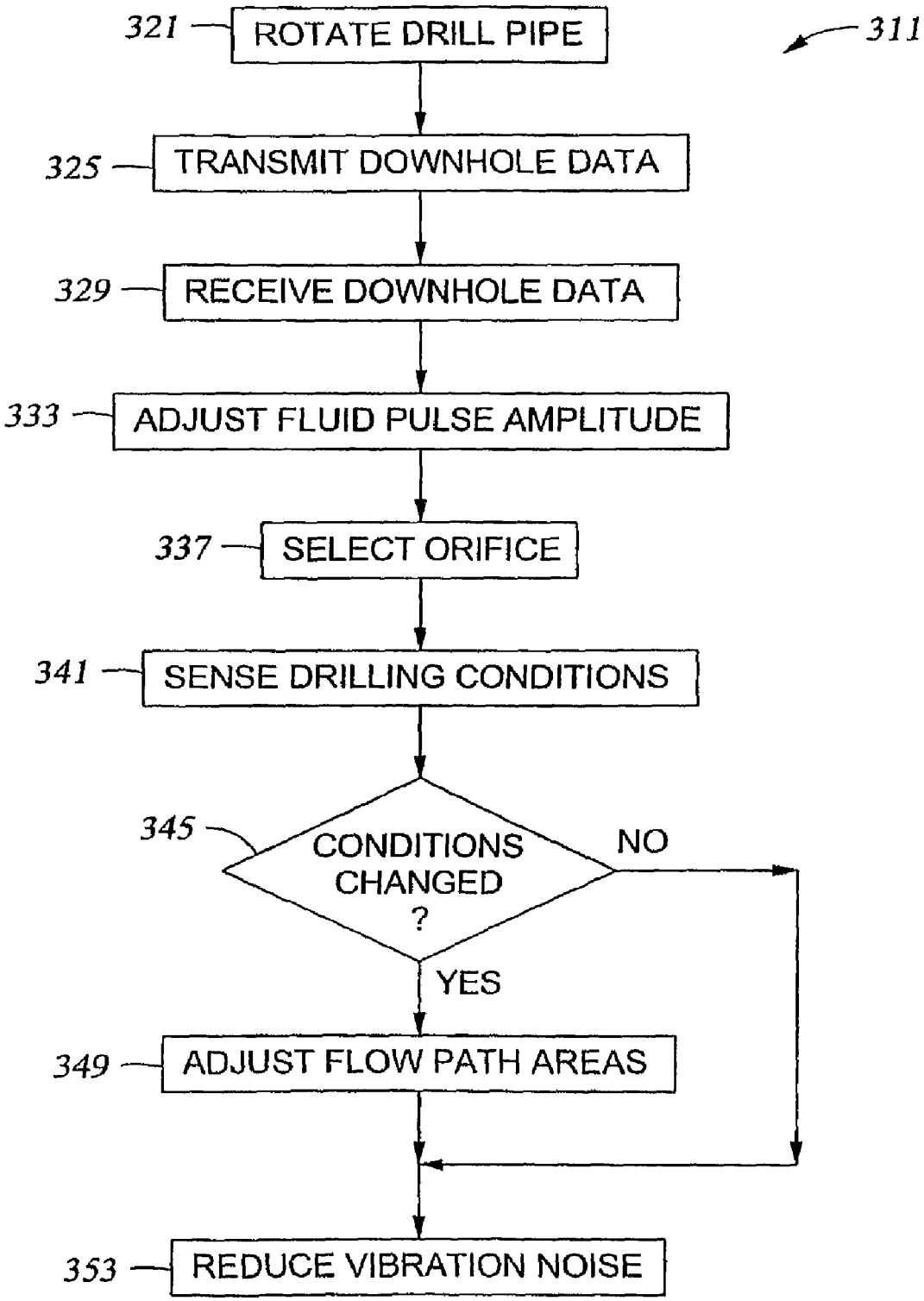
FIG. 3 is a flow chart illustrating several methods according to various embodiments of the invention.

For example, FIG. 3 is a flow chart illustrating several methods 311 according to various embodiments of the invention. In some embodiments, a method 311 may begin at block 321 with rotating a drill string/drill pipe using a top drive or a Kelly drive. The method 311 may continue with transmitting downhole data in a drilling fluid via fluid pressure modulation at block 325. The fluid pressure modulation may comprise pulse position modulation. In many embodiments, the method 311 includes receiving the downhole data at a fluid pulse receiver included in a conduit coupled to the drill pipe downstream from a Kelly hose at block 329.

The method 311 may also include adjusting fluid pulse amplitude in the drilling fluid by restricting drilling fluid flow at block 333. Restricting the drilling fluid flow may comprise passing the drilling fluid through an orifice attached to the conduit.

In some embodiments, the method 311 includes sensing drilling conditions at block 341. If it is determined that conditions have changed at block 345 (e.g., the mud weight or drilling fluid weight/viscosity have changed), then the method 311 may continue at block 349 with adjusting one or more flow path areas in the conduit responsive to the drilling conditions. Thus, the method 311 may include selecting a first orifice to attach to the conduit when drilling using a first mud weight, and selecting a second orifice to substitute for the first orifice when drilling using a second mud weight different from the first mud weight. The selection may be made manually (e.g., by a human), by machine (e.g., hydraulic selection, similar to what occurs in an automatic transmission with gear selection), or using a continuously adjustable aperture mechanism, as described above.

If no conditions have changed, as determined at block 345, then the method may continue to block 353 with reducing vibration noise in the downhole data by combining a modulated form of the downhole data with vibration information associated with a top drive or a Kelly drive coupled to the conduit. Other actions may also be accomplished as part of the method 311.

It should be noted that the methods described herein do not have to be executed in the order described, or in any particular order. Moreover, various activities described with respect to the methods identified herein can be executed in iterative, repetitive, serial, or parallel fashion. Information, including parameters, commands, operands, and other data, can be sent and received in the form of one or more carrier waves.

Upon reading and comprehending the content of this disclosure, one of ordinary skill in the art will understand the manner in which a software program can be launched from a computer-readable medium in a computer-based system to execute the functions defined in the software program. One of ordinary skill in the art will further understand the various programming languages that may be employed to create one or more software programs designed to implement and perform the methods disclosed herein. The programs may be structured in an object-orientated format using an object-oriented language such as Java or C++. Alternatively, the programs can be structured in a procedure-orientated format using a procedural language, such as assembly or C. The software components may communicate using any of a number of mechanisms well known to those of ordinary skill in the art, such as application program interfaces or interprocess communication techniques, including remote procedure calls. The teachings of various embodiments are not limited to any particular programming language or environment.

Thus, other embodiments may be realized. For example, an article according to various embodiments, such as a computer, a memory system, a magnetic or optical disk, some other storage device, and/or any type of electronic device or system may include a processor coupled to a machine-accessible medium such as a memory (e.g., removable storage media, as well as any memory including an electrical, optical, or electromagnetic conductor) having associated information (e.g., computer program instructions and/or data), which when accessed, results in a machine (e.g., the processor) performing any of the actions described with respect to the method above.

Using the coupling apparatus, systems, and methods disclosed herein may improve the SNR of received mud pulse telemetry. The transit time difference between receivers may be increased, improving waveform discrimination. Pulse telemetry signal amplitudes may also be increased, due to a reduction in destructive interference and high frequency attenuation. Pulse telemetry signal width may also be increased, as is sometimes desired in deeper wells, with compensating adjustments made in the location of the apparatus along the flow path length.

The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

In this description, numerous specific details such as logic implementations, opcodes, means to specify operands, resource partitioning, sharing, and duplication implementations, types and interrelationships of system components, and logic partitioning/integration choices are set forth in order to provide a more thorough understanding of various embodiments. It will be appreciated, however, by those skilled in the art that embodiments of the invention may be practiced without such specific details. In other instances, control structures, gate level circuits and full software instruction sequences have not been shown in detail so as not to obscure the embodiments of the invention.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

What is claimed is:

1. An apparatus, comprising:

a length of conduit to form a portion of a drilling fluid flow path, the conduit including a drill pipe attachment and a first opening to define a first flow path area along the drilling fluid flow path;

an orifice to reduce the first flow path area to a second flow path area defined by a second opening; and a fluid pulse receiver to receive modulated data propagated via pressure waves in a drilling fluid contained by the portion of the drilling fluid flow path.

2. The apparatus of claim 1, wherein the orifice is removably replaceable.

3. The apparatus of claim 1, wherein the orifice has an orifice length along the drilling fluid flow path that is less than the length of the conduit along the drilling fluid flow path.

4. The apparatus of claim 1, wherein the second opening defines an exit point of a substantially tapered orifice chamber.

5. The apparatus of claim 1, wherein the fluid pulse receiver is attached to the conduit downstream along the drilling fluid flow path from the orifice.

6. The apparatus of claim 1, wherein the fluid pulse receiver is located less than 10% of a downstream sonic distance defined by an average pulse width of the modulated data in the drilling fluid from the orifice along the drilling fluid flow path.

7. The apparatus of claim 1, comprising:

a wireless transmitter to couple to the fluid pulse receive.

8. The apparatus of claim 1, comprising:

a conversion module to convert the modulated data from an analog form to a digital form.

9. The apparatus of claim 7, comprising:

an additional fluid pulse receiver coupled to the wireless transmitter.

10. The apparatus of claim 1, wherein the conduit comprises substantially cylindrical metallic pipe.

11. The apparatus of claim 1, wherein the fluid pulse receiver is attached to the conduit.

12. The apparatus of claim 1, wherein one of the first flow path area and the second flow path area is adjustable responsive to one of a mechanical force and an electrical signal.

13. A system, comprising:

a length of conduit to form a portion of a drilling fluid flow path, the conduit including a drill pipe attachment and a first opening to define a first flow path area along the drilling fluid flow path;

an orifice to reduce the first flow path area to a second flow path area;

a first fluid pulse receiver to receive modulated data propagated via pressure waves in a drilling fluid contained by the portion of the drilling fluid flow path; and a drill string coupled to the drill pipe attachment.

14. The system of claim 13, comprising:

a logging while drilling (LWD) tool to provide the data and coupled to the drill string.

15. The system of claim 13, comprising:

one of a top drive or a Kelly drive coupled directly to the conduit.

16. The system of claim 15, comprising:

a vibration transducer attached to the one of the top drive or the Kelly drive.

17. The system of claim 13, comprising:

a mud pump to pump the drilling fluid; and a pulsation dampener coupled to the mud pump.

18. The system of claim 17, wherein the first fluid pulse receiver is located approximately one-half of a downstream sonic distance defined by an average pulse width of the data in the drilling fluid from the pulsation dampener along the drilling fluid flow path.

19. The system of claim 17, wherein one of the first flow path area and the second flow path area is adjustable responsive in substantially real time to drilling conditions.

20. The system of claim 17, further comprising:

a Kelly hose fluidly coupled to the conduit, wherein the first fluid pulse receiver is to monitor a first fluid pressure along the drilling fluid flow path on a drill string side of the Kelly hose.

21. The system of claim 20, further comprising:

a second fluid pulse receiver spaced apart from the first fluid pulse receiver along the drilling fluid flow path, the second fluid pulse receiver to monitor a second fluid pressure along the drilling fluid flow path on the drill string side of the Kelly hose.

22. The system of claim 20, further comprising:

a second fluid pulse receiver spaced apart from the first fluid pulse receiver along the drilling fluid flow path, the second fluid pulse receiver to monitor a second fluid pressure along the drilling fluid flow path on a non-drill string side of the Kelly hose.

23. A method, comprising:

transmitting downhole data in a drilling fluid via fluid pressure modulation; and receiving the downhole data at a fluid pulse receiver included in a conduit coupled to a drill pipe downstream from a Kelly hose.

24. The method of claim 23, comprising:

rotating the drill pipe using one of a top drive or a Kelly drive.

25. The method of claim 23, comprising:

adjusting fluid pulse amplitude in the drilling fluid by restricting drilling fluid flow.

26. The method of claim 25, wherein restricting the drilling fluid flow comprises:

passing the drilling fluid through an orifice attached to the conduit.

27. The method of claim 23, comprising:

reducing vibration noise in the downhole data by combining a modulated form of the downhole data with vibration information associated with a top drive or a Kelly drive coupled to the conduit.

28. The method of claim 23, comprising:

selecting a first orifice to attach to the conduit when drilling using a first mud weight; and selecting a second orifice to substitute for the first orifice when drilling using a second mud weight different from the first mud weight.

29. The method of claim 23, wherein the fluid pressure modulation comprises pulse position modulation.

30. The method of claim 23, comprising:

sensing drilling conditions; and adjusting at least one of a first flow path area in the conduit and a second flow path area in the conduit responsive to the drilling conditions.

* * * * *